United States Patent [19]

Melendy

[11] Patent Number: 4,986,680

[45] Date of Patent: Jan. 22, 1991

[54] GLUE STICK AND APPLICATOR

[76] Inventor: Peter S. Melendy, R.F.D. #1, 3 Flanders Dr., Brentwood, Exeter, N.H. 03833

[21] Appl. No.: 301,709

[22] Filed: Jan. 26, 1989

[51] Int. Cl.[5] ..... B65H 20/00

[52] U.S. Cl. ..... 401/1; 401/2; 226/127; 222/146.5

[58] Field of Search ..... 401/1, 2; 226/127; 222/146.5; 264/148

[56] References Cited

U.S. PATENT DOCUMENTS

| | | | |
|---|---|---|---|
| 4,523,705 | 6/1985 | Belanger | 226/127 |
| 4,601,597 | 7/1986 | Bertram et al. | 401/2 |
| 4,639,155 | 1/1987 | Schuster et al. | 401/2 |

FOREIGN PATENT DOCUMENTS

| | | | |
|---|---|---|---|
| 2199085 | 6/1988 | United Kingdom | 401/1 |

*Primary Examiner*—Mickey Yu
*Assistant Examiner*—Kerry Owens
*Attorney, Agent, or Firm*—Berman, Aisenberg & Platt

[57] ABSTRACT

In a hot-melt adhesive system, a glue stick is provided with a transverse cross section which is acircular. A glue gun is provided with an acircular opening in the gripper housing and an acircular opening in the heating element to accommodate a glue stick. In a preferred embodiment, the major dimension of the glue stick is approximately one-half inch while the smaller dimension is slightly more than one-quarter inch. The acircular glue stick provides excellent heat transfer in the heating chamber and permits a simpler manufacturing process. The gripper housing includes a gripper element which engages a major part of the width of the glue stick and can transmit a large advancing force without becoming embedded in the stick.

20 Claims, 2 Drawing Sheets

GLUE STICK AND APPLICATOR

TECHNICAL FIELD

This invention relates to the art of adhesives. In the preferred embodiment, the invention relates to a stick of hot-melt adhesive and an applicator for use with that stick.

BACKGROUND ART

In a known hot-melt adhesive system, a stick of hot-melt adhesive material is cylindrical and has a diameter of substantially one-half inch. While it is not clear why this particular dimension was chosen originally, there are several factors which have dictated the use of a cylindrical stick having a diameter of approximately this dimension.

The cylindrical stick is manufactured through extrusion, and the circular cross section is maintained by twisting the stick as it comes from the extruder and passes to a cooling bath.

The one-half inch diameter allows a fairly efficient manufacturing process, and more sophisticated process controls are required to maintain the circular cross section as the diameter increases. In addition, if the diameter were larger than one-half inch, the tendency of the extruded stick to sag would increase, thus requiring additional steps in the manufacturing process. Moreover, a one-half inch stick cools on the outside fairly quickly to prevent sagging of the stick even while the inside is still soft. If the diameter were increased beyond one-half inch, the cooling of the outside surface would be inadequate to prevent sagging of the stick during the normal extrusion process. Further, if the diameter were increased, the glue stick would likely not cool (unless the cooling time were increased) before cutting or packaging which would result in further manufacturing and shipping problems.

The cylindrical glue stick shape is also critical to the design of a traditional glue gun. In the traditional glue gun, the glue stick is pushed into a heating chamber where it is melted. The unmelted portion of the glue stick thus acts as a seal for preventing the melted glue from flowing out of the heating chamber. Also, the hard glue stick is a piston which provides pressure to force the melted glue out of the nozzle. Thus, a good seal must be provided between the glue stick and the heating chamber. Glue which leaks out of the heating chamber cools in the mechanism of the gun and jams the mechanism of the glue gun.

The diameter and shape of the glue stick also affect the heating efficiency. In the heating chamber the glue stick is heated from the outside surface, and a round stick does not transfer heat efficiently because the surface area of the stick is small compared to its volume. Adhesive material is generally a thermal insulator, and one problem faced in the design of the heating chamber is that the center of the glue stick may still be hard when the outer portion is melted. One traditional solution to this problem is to provide fins in the heating chamber for penetrating the chamber and carrying heat to the center of the glue stick.

The shape and diameter of the glue stick also affects the choice of glue material. If the material is too soft, the glue stick will deform to such an extent that it prevents application of adequate pressure in the pressure chamber. If the glue stick is too hard, it will not deform enough to form the necessary seal with the heating chamber. If the diameter of a cylindrical glue stick is substantially less than one-half inch, the choice of material becomes critical because it must be formed of harder materials to have the necessary rigidity.

The shape of the glue stick also has an impact on the design of the glue gun. A stick is typically advanced into the heating chamber by a mechanism which grips the stick. If the adhesive material is hard, the gripping mechanism may not be able to engage the stick properly, thus preventing proper advancement of the stick into the heating chamber. If the material is too soft, the gripper may become embedded in the glue and not released properly at the end of the stroke, also preventing proper advancement of the stick. One objective is to distribute the gripping force over the stick, but this has not been practical with cylindrical sticks.

SUMMARY OF THE INVENTION

While the problems noted above with respect to cylindrical glue sticks have traditionally been addressed by modifications in the heating chamber, the advancing mechanism, or the composition of the glue stick, Applicant has determined that greater flexibility is available if the shape of the glue stick is acircular. In accordance with the invention, Applicant provides a glue stick having an acircular cross section and a glue gun having a heating chamber and advancing mechanism capable of accepting a glue stick of this shape.

In a preferred embodiment, the glue stick is elongate and has a transverse cross section which is a modified oval. This shape results in a stick having a dimension from the surface of the stick to the center which is less than that of a cylindrical glue stick. This reduced dimension improves the heat transfer out of the glue stick during the cooling portion of the production process and provides greater heat transfer into the stick when in the heating chamber during use. The glue stick, thus, cools faster during production, allowing greater simplicity in the production process. Similarly, the transfer of heat in the heating chamber is faster and results in a wider range of choices for the adhesive material and the heating elements.

The greater surface area provided by the acircular cross section provides greater sealing at the inlet to the heating chamber, thus permitting the use of lower viscosity materials.

The acircular cross section stick provides a rigidity which is similar to that of cylindrical stick having a radius equal to the maximum dimension of the new oval stick. This increased rigidity permits the use of compositions having low Durometer values without requiring extensive redesign of the feed mechanism in the glue gun.

The oval cross section has a longer dimension on two sides, and the gripper of the improved glue gun is designed to engage this longer dimension. This allows a greater feeding force to be applied to the gripper, but the gripper is not caused to penetrate the stick because the greater force is spread out over a larger area.

In a preferred embodiment, a glue gun provides a heating chamber having an inlet with a transverse cross section similar to the acircular cross section of the improved glue stick. An advancing mechanism similarly has a transverse cross section which substantially matches that of the glue stick to receive the glue stick and feed it into the heating chamber. Other parts of the glue gun, such as the drag ring and the seal to the heating chamber have similar cross sectional shapes.

One advantage of this design is a glue gun which has a smaller dimension in one direction. Such a gun is more compact and is useful for many purposes, such as fitting in tight corners.

The glue stick having an acircular cross section has other advantages. For example, because the sticks are not cylindrical, they do not roll off of a work table. The flat side of the glue stick can be printed with the product identification without significant distortion of the printed identification in contrast to the distortion caused by printing on a cylindrical glue stick.

An object of this invention is to provide an improved hot-melt adhesive stick having an acircular transverse cross section.

Another object of this invention is to provide an improved glue gun capable of receiving a glue stick having an acircular cross section.

DETAILED DESCRIPTION OF THE INVENTION

Figure 1A:
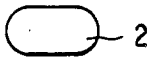
FIG. 1A is an end view of a glue stick in accordance with the invention showing a preferred cross sectional shape.
Figure 1B:
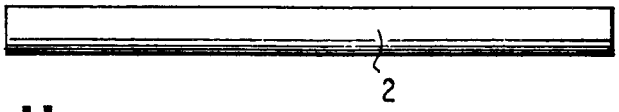
FIG. 1B is a side view of the glue stick shown in FIG. 1A.

With reference to FIGS. 1A and 1B, a glue stick 2 is generally elongate and has a transverse cross section, shown in the end view of FIG. 1A, which is a modified oval FIG. 1B is a side view of a glue stick in accordance with the invention, the stick having a length of approximately two to ten inches. The acircular transverse cross section shown in FIG. 1A is formed by two circles having a diameter of approximately 0.290 inches and linear portions connecting the two circles. The overall width of the glue stick is preferably about 0.513 inches. Thus, the glue stick shown in FIGS. 1A and 1B has a larger transverse dimension of approximately one-half inch and a shorter transverse dimension just larger than one-quarter inch.

Figure 2:
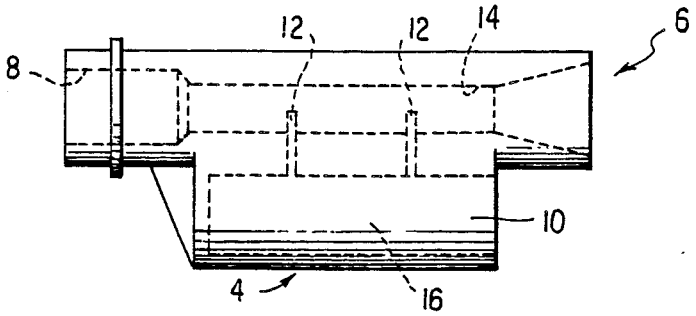
FIG. 2 is a side view of a heating element for use in a glue gun in accordance with the invention.

FIG. 2 is a side view of a heating element 4 which is adapted to fit in a glue gun as is known in the art. Heating element 4 includes an inlet 6 for receiving the glue stick shown in FIG. 1A. An outlet 8 is adapted to receive a nozzle having a spring-loaded ball valve for permitting application of melted glue. Heating element 4 includes a cavity in lower part 10 for receiving a PTC heating element (element 16 of FIG. 3) as is known in the art. Fins 12 extend into a heating chamber 14 to assist in transmitting energy from the PTC element into the heating chamber. As noted above, the fins may be eliminated for many compositions because of the increased heating efficiency resulting from the acircular shape.

Figure 3:
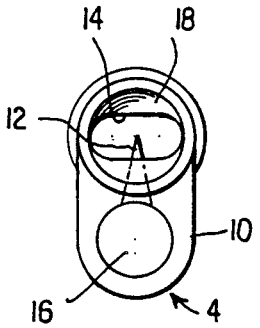
FIG. 3 is an end view of the heating element shown in FIG. 2 showing the inlet end.
Figure 4:
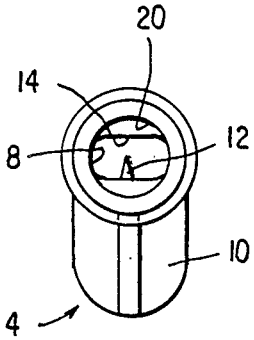
FIG. 4 is an end view of the heating element shown in FIG. 2 showing the outlet end.

FIG. 3 is an end view of the heating element 4 and shows PTC element 16 received in a cavity in portion 10. The inlet opening 18 is provided with a transverse shape which substantially matches that of the adhesive stick shown in FIGS. 1A and 1B. As shown in FIG. 3, fins 12 extend to the heating chamber 14. With reference to FIG. 4, which is an end view of the heating element 4 from the outlet end, an outer surface 20 of the heating chamber 14 is circular. The heating chamber preferably tapers from the modified oval shape shown in FIG. 3 to a circular profile in the heating chamber 14. Thus, as the adhesive is melted, it fills a substantially cylindrical chamber prior to being expelled from end 8 through the ball valve (not shown).

Figure 5:
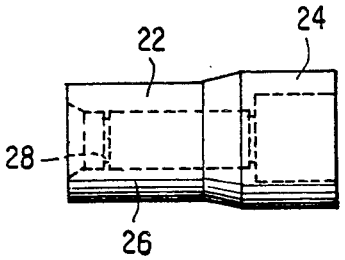
FIG. 5 is a top view of a silicone sleeve for use with the heating element of FIG. 2.
Figure 6:
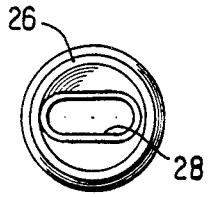
FIG. 6 is an end view of the sleeve showing the inlet end.
Figure 7:
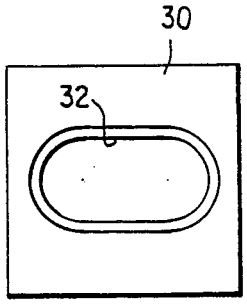
FIG. 7 is a front view of a drag ring for use in a glue gun in accordance with the invention.

FIG. 5 shows a sleeve 22 which is preferably made of silicone. One end 24 of sleeve 22 fits over inlet end 6 of heating element 4, and end 26 receives the glue stick 2. FIG. 6 is an end view of the sleeve 22 showing an opening 28 in end 26, the profile of opening 28 substantially matching the profile of glue stick 2. This sleeve provides a tight seal with the outer surface of glue stick 2 to prevent the escape of molten glue from the heating chamber. As discussed above, the provision of an acircular cross section for the glue stick results in a greater contact between the opening 28 in the sleeve 22 and the outer surface of the glue stick. This provides a better seal and prevents leakage of the melted glue into the mechanism of the gun even at higher pressures FIG. 7 shows a drag ring 30 having a lip 32 forming a modified oval which also matches the cross sectional shape of the glue stick 2 The drag ring is located on the rear of a glue (not shown) and the glue stick is inserted into the drag ring when being inserted into the glue gun. Among other purposes, the drag ring prevents the glue stick from falling out of the glue gun accidentally.

Figure 8:
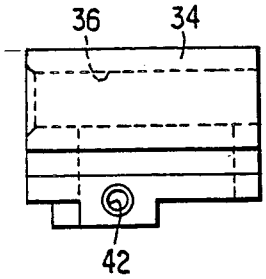
FIG. 8 is a side view of a housing for a gripper for use in a glue gun in accordance with the invention.
Figure 9:
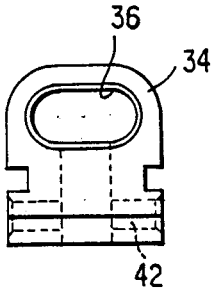
FIG. 9 is a front view of the housing shown in FIG. 8.

FIG. 8 is a side view of a gripper housing 34, and FIG. 9 is an end view of the gripper housing. Gripper housing 34 is mounted within a glue gun and is activated by the trigger mechanism of the glue gun. The gripper housing carries the glue stick forward as it is moved forward by activation of the trigger mechanism. This feeds the glue stick into the heating chamber 14 as is known in the art. Gripper housing 34 includes a hollow center 36 which again has a cross section which is a modified oval to accommodate the acircular profile of the glue stick 2 shown in FIGS. 1A and 1B.

Figure 10:
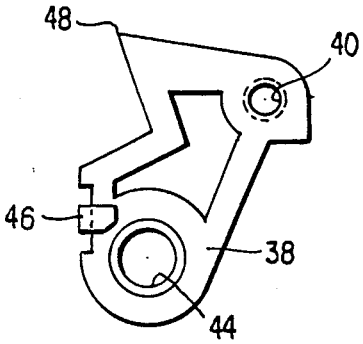
FIG. 10 is a side view of a gripping element for use with the housing shown in FIG. 8.

FIG. 10 shows a gripping element 38 which is pivotally mounted by a pin (not shown) which passes through opening 40 in gripper element 38 and opening 42 in the gripper housing 34 (see FIGS. 8 and 9). Opening 44 in gripper element 38 receives a pivotal mounting pin of the trigger mechanism, and extension 46 receives a return spring. The disclosure of U.S. Pat. No. 4,523,705 is incorporated by reference for an explanation of how activation of the trigger mechanism causes rotation of the gripper element 38 to engage the glue stick and to advance it into the heating chamber.

One advantage of the acircular shape of hollow center 36 is that the gripping surface 48 of gripper element 38 may be the length of the linear portion of the cross section of the glue stick shown in FIG. 1A. Thus, the gripping surface 48 may be longer than that normally provided with a circular glue stick, thus distributing the force on the gripping surface over a larger area. This allows the application of a larger gripping force while maintaining a low pressure on the gripping surface to prevent penetration of the gripping surface 48 into the surface of the glue stick. By this construction, it is less likely that the gripping element will become embedded and stuck in the glue stick.

It will be appreciated that a unique design for a glue stick and glue gun have been described. Modifications of the invention within the scope of the appended claims will be apparent to those of skill in the art.

I claim:

1. In an elongate glue stick of the type which comprises an adhesive material which melts at a temperature substantially above room temperature and is adapted to be received in a heating chamber of an applicator, the improvement wherein the transverse cross section of said glue stick comprises a height and a width wherein said height is less than about 0.6 times said width for substantially increasing the conduction of heat to the center of said stick.

2. The glue stick of claim 1 wherein said cross section is oval.

3. The glue stick of claim 2 wherein said oval cross section comprises circular end portions.

4. The glue stick of claim 3 wherein said cross section comprises linear portions between said end portions.

5. A glue applicator comprising a heating chamber for receiving and melting a stick of adhesive having a transverse cross section having a height and a width wherein said height is less than about 0.6 times said width for substantially increasing the conduction of heat to the center of said stick and gripper means for advancing said stick into said chamber, wherein said heating chamber comprises inlet means for receiving said stick and having said transverse cross section and said gripper means comprises a gripper housing having said transverse section, whereby a stick of adhesive having said transverse cross section may be fed into said chamber by said gripper.

6. A glue applicator according to claim 5 wherein the transverse cross section of said heating chamber tapers from said inlet to a portion having a circular transverse cross section.

7. A glue applicator according to claim 5 wherein said gripper means comprises a gripper element attached to said housing, said element extending across a larger transverse dimension of said housing for engaging a surface of said glue stick having a larger transverse dimension.

8. A glue applicator according to claim 5 wherein said transverse cross section is oval.

9. A glue applicator according to claim 8 wherein said oval cross section comprises circular end portions and linear portions between said end portions, and wherein said gripper means comprises a gripper element attached to said housing for engaging one of said linear portions.

10. A glue applicator comprising a heating chamber for receiving and melting a stick of adhesive having a transverse cross section having a height and a width wherein said height is less than about 0.6 times said width for substantially increasing the conduction of heat to the center of said stick wherein said heating chamber comprises inlet means with said transverse cross section for receiving a stick of adhesive having said transverse cross section.

11. A glue applicator according to claim 10 wherein said cross section is oval.

12. A glue applicator according to claim 11 wherein said cross section comprises circular end portions and linear portions between said end portions.

13. A glue stick according to claim 1 wherein the ratio of said height to said width is about 0.5

14. A glue stick according to claim 13 wherein said height is larger than about 0.25 inch and said width is approximately 0.5 inch.

15. A glue applicator according to claim 5 wherein the ratio of said height to said width is about 0.5.

16. A glue applicator according to claim 15 wherein said height is larger than about 0.25 inch and said with is approximately 0.5 inch.

17. A glue applicator according to claim 5 wherein said inlet means comprises a flexible sleeve.

18. A glue applicator according to claim 10 wherein the ratio of said height to said width is about 0.5.

19. A glue applicator according to claim 18 wherein said height is larger than about 0.25 inch and said width is approximately 0.5 inch.

20. A glue applicator according to claim 19 wherein said inlet means comprises a flexible sleeve.

* * * * *